United States Patent [19]

Kazmaier et al.

[11] Patent Number: 4,478,058

[45] Date of Patent: Oct. 23, 1984

[54] TAKE DOWN MECHANISM FOR FLAT KNITTING MACHINES

[75] Inventors: Günther Kazmaier, St. Johann-Ohnastetten; Ernst Goller, Reutlingen, both of Fed. Rep. of Germany

[73] Assignee: H. Stoll GmbH & Co., Reutlingen, Fed. Rep. of Germany

[21] Appl. No.: 478,998

[22] Filed: Mar. 25, 1983

[30] Foreign Application Priority Data

May 8, 1982 [DE] Fed. Rep. of Germany ..... 3217395

[51] Int. Cl.[3] ..... D04B 7/04

[52] U.S. Cl. ..... 66/149 R

[58] Field of Search ..... 66/149 R, 152

[56] References Cited

U.S. PATENT DOCUMENTS 3,618,343 11/1971 Essig ..... 66/149 R 3,760,609 9/1973 Poocza et al. ..... 66/149 R

FOREIGN PATENT DOCUMENTS 154973 10/1963 U.S.S.R. ..... 66/149

*Primary Examiner*—Ronald Feldbaum

*Attorney, Agent, or Firm*—Larson and Taylor

[57] ABSTRACT

In the take-down mechanism the plurality of coaxial roller sections (14.1 . . . 14.x) of the take-down roller are moveable on a common shaft (16) and adapted to be coupled separately and selectively with a driving means (17/18) that is to say independently of one another. A return rotary movement of the roller sections is prevented by one-way clutches constituted by loop springs (35,36). The common shaft (16) can be turned for adjustment of all the roller sections in common. Annular guards (28) prevent threads intruding between the individual roller sections (14). (FIG. 1).

8 Claims, 3 Drawing Figures

TAKE DOWN MECHANISM FOR FLAT KNITTING MACHINES

Figure 1:
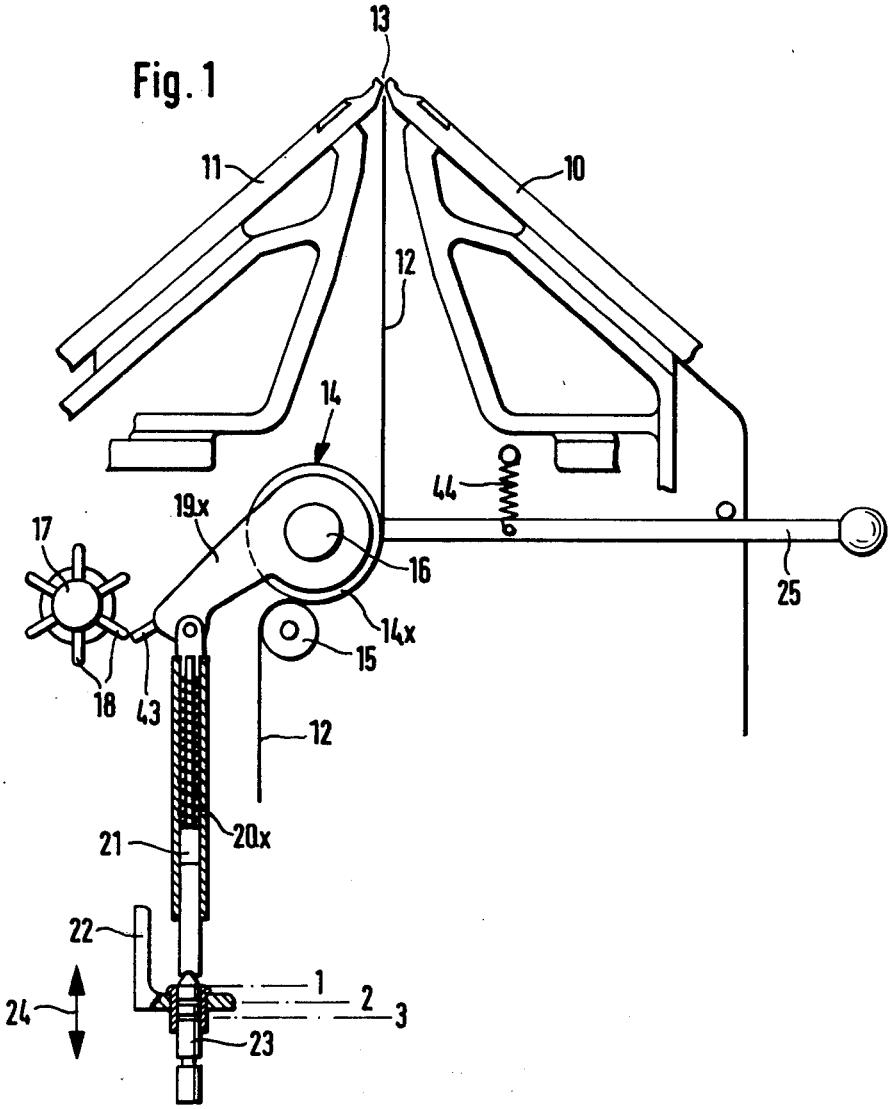

This invention relates to a take-down mechanism for flat knitting machines comprising a fabric take-down roller which cooperates with a press roller and is divided into a plurality of coaxial component roller sections with profiled surfaces.

Take-down mechanisms with these features are known. In these mechanisms the roller sections are arranged on a common shaft rotatable by a pawl and ratchet means. A torsion spring is engaged between each roller section and the driven shaft and is tightened up during each indexing step of the shaft. The torsion springs take care of the tension arising from the pull on the knitted fabric.

Take-down mechanisms hitherto known are notorious for the very uniform take-down effect of each roller section. This however is a detrimental factor in the case of flat knitting machines on which knitted fabrics with lengthy stitch-transfer zones, or knitted fabrics are made. To cater for these there should be individual setting of the take-down effect varying from area to area.

The basic object of the invention is to provide a take-down mechanism for flat knitting machines in which the take-down effect can be defined in individual areas of the fabric and suited to the finished product.

This object is achieved with a take-down mechanism of the type set forth above by the fact that all the component roller sections are mounted for unidirectional rotation on a common shaft which is normally held stationary, and each roller section can be coupled separately and selectively with a driving means.

With the take-down mechanism of this invention the roller sections can therefore optionally be individually cut out or be operated at a different rate and thus with a different take-down effect and so adapted to the knitted product or to the distribution of the product over the length of the needle bed. Each roller section has its own driving means which advantageously includes a pivotal lever mounted on the common shaft and biassed into a rest position by an adjustable spring. This spring can be set individually and the pivotal lever can advantageously be firstly actuated by a star-form cam which may be arranged on an operating shaft which also carries other pivot levers arranged in mutually staggered fashion and secondly be coupled non-rotatably in the takedown direction through a loop spring clutch with the roller section. By reason of the use of loop spring clutches, which can be built into the roller sections, there is not only a more secure one-way coupling of the roller sections but an additional guard against the recoil rotation which has previously had to be prevented by using external ratchet and pawl element.

In a preferred embodiment the pivotal levers may be connected, as a means for operating each roller section, with a sleeve which is freely mounted on the shaft common to all the roller sections, for their part the roller sections being concentrically disposed on the sleeve and coupled, firstly with the sleeve through a one-way clutch having right handed (or left handed) loop springs and secondly with the clutch ring (non-rotatable) on the shaft through a one-way clutch having left handed (or right handed) loop springs.

The take-down mechanism of this invention also caters for common adjustment of all the roller sections by having the common shaft rotatable from a change-over, preferably hand-operated, gear. Further supports for all the pre-loading springs associated with the roller sections can be arranged on a carrier for all of them and adjustable to vary the pre-loading of the springs in common.

Figure 2:
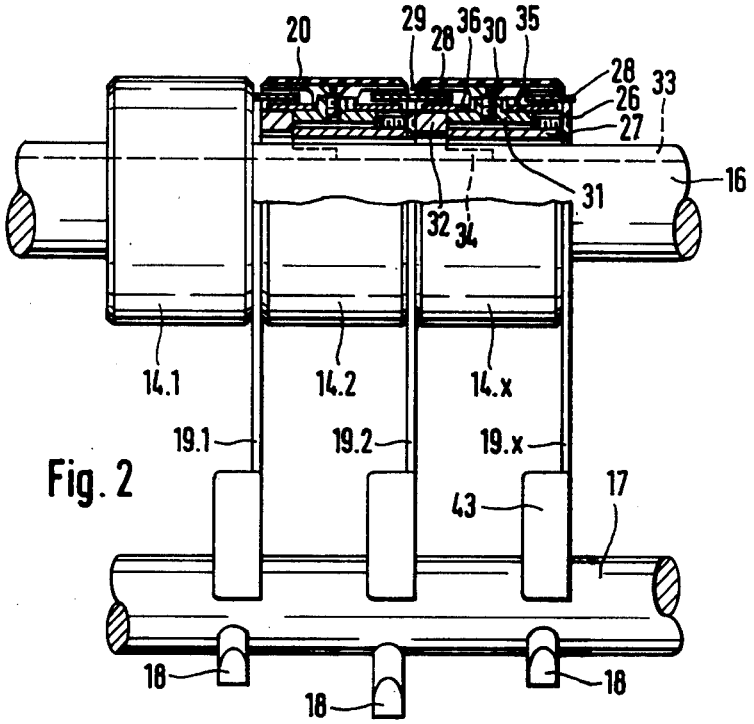
Figure 3:
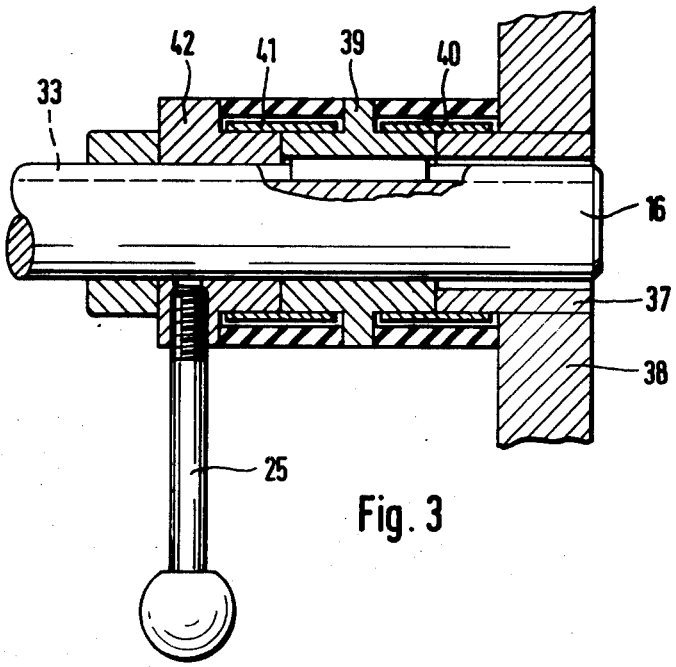

An example of embodiment of the take-down mechanism falling within this invention is described below with reference to the accompanying drawings. In these drawings:

FIG. 1 is a diagrammatic cross section through a V-bed flat knitting machine incorporating the take-down mechanism, FIG. 2 is a side view of three component roller sections in this take-down mechanism, shown partly in section, FIG. 3 is a cross section through the means for adjusting the common shaft of the component sections of the take-down roller.

The diagrammatic cross section of FIG. 1 shows the two needle beds 10 and 11 of a flat knitting machine and a knitted fabric web 12 made on this machine extending downwards from the comb gap 13 of the machine to a take-down roller 14 and thence downwards over a press roller 15. The shaft 16 and one of its roller sections 14.x is shown. The driving means for the fabric take-down roller 14 comprises a common drive shaft 17 which has cams comprising pins 18 in star formation for each roller section 14.x, each cam acting on the associated pivotal lever 19.x by means of which the associated roller section 14.x can be set through a compression spring 20.x which pre-loads the lever 19.x in the take-down direction. The compression spring 20.x is indirectly coupled at one end with the pivotal lever 19.x whilst at the other end it is supported against a bearing 21 which can be adjusted in position, for example to the indicated positions 1, 2 and 3, by a setting screw 23 mounted on a carrier 22 which is common to all the compression springs. As indicated by the double arrow 24 the common carrier 22 can be adjusted in the vertical direction to provide for common adjustment of the pre-loading of all the compression springs 20.x.

FIG. 1 also shows a hand lever 25 with a return spring 44, the purposes of which will be later explained in connection with FIG. 3.

FIG. 2 shows three component roller sections 14.1, 14.2 and 14.x with profiled surfaces, the latter for example being in the form of a rubber coating 25, and shows the pivotal levers 19.1, 19.2 and 19.x associated therewith and the pertinent cam stars or pin starts 18 of the common driving shaft 17. The pivotal levers 19.1 are each provided at the free end with an abutment piece 43 ready to be struck by a pin 18 of the associated pin star on the driving shaft 17 and, at the other end is connected through screws 26 with a sleeve 27 which is freely rotatable on the shaft 16, which latter is normally held firm. Each pivotal lever 19.1 . . . 19.x is further connected with an annular guard 28 which is concentric on the shaft 16 and covers the gap 29 between each roller section 14.1 . . . 14.x at the interior to prevent threads being drawn into this gap.

The actual roller section 14.1, 14.2 . . . 14.x is rigidly connected through screws 30 with an inner toothed ring 31 which is freely rotatable on the concentric sleeve 27. In addition there is disposed within each roller section 14.1 . . . 14.x a clutch ring 32 which is non-rotatably connected to the shaft 16 through a spring 34 engaging in a longitudinal groove 33 in the shaft 16.

Each roller section 14.1 is coupled through its toothed ring 31 firstly with the sleeve 27 through a right handed loop spring 35, which extends partly over the ring 31 and partly over the sleeve 27, and secondly with the clutch ring 32 through a left handed loop spring 36 which extends partly over the toothed ring 31 and partly over the clutch ring 32. The loop springs 35, 36 act in the usual way as one-way clutches. The right handed loop spring 35 has the effect that during the adjustment movement of the pivotal lever 19.1 . . . 19.x in the counter clockwise direction provoked by the pin star the roller section associated therewith does not move with it, whilst during the return movement of the pivot lever 19.1 . . . 19.x in the clockwise direction the right handed loop spring 35 under the effect of the compression spring 20.x provokes a movement of the associated roller section 14.x with it.

The left handed loop spring 36 produces a one-way coupling of the relevant roller section 14.x with the shaft 16 and has, in combination with a clamping device operable by the hand lever 25, illustrated in FIG. 3 and common to all the roller sections 14.x, importance in preventing a turning back of the roller component sections 14.1 . . . 14.x under the tension of the knitted fabric. The shaft 16, normally held stationary, is (see FIG. 3) rotatably mounted at each end in a rigid bearing bush 37 in a wall 38 of the machine frame. Whilst during the adjustment movement of the roller section 14.x provoked by the right handed loop spring 35 the left handed loop spring 36 permits this movement relatively to the clutch ring 32, turning of this clutch ring 32 during a rotation of the shaft 16 by the left handed loop spring 36 involves the movement of the associated relevant roller section 14.x.

The common clamping device operable by the hand lever 25 also has one-way couplings constituted by loop springs. In the first place a clutch sleeve 39 engaged with the longitudinal groove 33 of the shaft 16 is coupled through a right handed loop spring 40 with the firm bearing bush 37. On the other hand this clutch sleeve 39 is coupled through a right handed loop spring 41 with a changeover sleeve 42 which is freely rotatable on the shaft 16 and which is engaged by the hand lever 25. Only in one of the two pivotal directions of the hand lever 25 is there a coupling, through the left handed loop spring 41, of the changeover sleeve 42 with the clutch sleeve 39 and thus an entrained rotary movement of the shaft 16, which movement in this case is not obstructed by the right hand loop spring 40, that is to say the right handed loop spring 40 permits a relative movement of the clutch sleeve 39 relatively to the bush 37 during the entrained rotary movement of the shaft 16. As regards the opposite direction of rotation the right handed loop spring 40 provokes a coupling between the sleeve 39 and the bush 37 and thus prevents any back rotation of the shaft 16.

As can be seen from FIG. 2, the pins on the pin star 18 are advantageously offset relatively one to another. By removing the pins 18, a movement out of the way of the abutment elements of a pivotal lever 19 or the like can provide for stationing of a roller 14.x. By removing individual pins 18 it is possible to dispense with a number of changeover steps in the case of individual roller sections 14.x. The pivotal levers 19.x do not have to be loaded by compression springs 20.x but may be placed under the influence of adjustable tension springs.

We claim:

1. A take-down mechanism for flat knitting machines comprising a fabric take-down roller which cooperates with a press roller and is divided into a plurality of coaxial component roller sections with profiled surfaces, characterised by the fact that all the component roller sections (14.1 . . . 14.x) are mounted for unidirectional rotation on a common shaft (16) which is normally held stationary, and each roller section (14.1 . . . 14.x) can be coupled separately and selectively with a driving means (17/18).

2. A take-down mechanism according to claim 1, characterised by the fact that each roller section (14.1 . . . 14.x) has associated therewith a pivotal lever (19.1 . . . 19.x) which is mounted on a common shaft (16) and is biassed by an adjustable spring (20) into a starting position and each pivotal lever (19.1 . . . 19.x) on the one hand is adapted to be struck by a rotatable cam star (18) on a driving shaft (17) carrying a plurality of such stars and, on the other hand, is coupled through a loop spring clutch (35) with the roller section (14.1 . . . 14.x) non-rotatably in the take-down direction.

3. A take-down mechanism according to claim 1, characterised by the fact that each pivotal lever (19.1 . . . 19.x) is connected to a sleeve (27) which is mounted for free rotation on the common shaft (16) and the roller section (14.1 . . . 14.x) is concentrically disposed on this sleeve and, firstly, is coupled through a right-handed (or left handed loop spring (35) with the sleeve (27) and, secondly, through a one-way clutch with left handed (or right handed) loop springs (36) with a clutch ring (32) non-rotatably mounted on the shaft (16).

4. A take-down mechanism according to claim 1, characterised by the fact that the common shaft (16) has a continuous groove (33) for receiving springs to anchor the clutch ring (32).

5. A take-down mechanism according to claim 1, characterised by the fact that each pivotal lever (19.1 . . . 19.x) is connected to a guard ring (28) concentric with the common shaft (16) which covers the interspace (28) between two adjacent roller sections (14.1 . . . 14.x) towards the shaft (16).

6. A take-down mechanism according to claim 1, characterised by the fact that a support (21) is provided for a pre-loading spring acting on each pivotal lever (19.1 . . . 19.x) and is adjustable to vary the spring loading, and the appropriate supports (21) of all the pre-loading springs (20.x) and arranged on a common carrier (22) which can be adjusted to bring about variation in common of the springs.

7. A take-down mechanism according to claim 1, characterised by the fact that the common shaft (16) is mounted for rotation by means of a one-way changeover device (39-42).

8. A take-down mechanism according to claim 7, characterised by the fact that the one-way changeover device is operable by a hand lever (25) and has two oppositely-acting loop springs (40, 41) as coupling members.

* * * * *